United States Patent [19]

Bengtsson

[11] 3,996,647

[45] Dec. 14, 1976

[54] BUTTON INCLUDING A MALE AND FEMALE PORTION

[76] Inventor: Sigurd Walter Bengtsson, Bruksgatan 17, 414 51 Goteborg, Sweden

[22] Filed: June 9, 1975

[21] Appl. No.: 585,114

[30] Foreign Application Priority Data

June 12, 1974 Sweden ..... 7407731
Sept. 19, 1974 Sweden ..... 7411770

[52] U.S. Cl. ..... 24/90 E; 24/90 F; 24/101 R

[51] Int. Cl.[2] ..... A44B 1/28

[58] Field of Search ..... 24/90 E, 90F, 90 PR, 24/101 FS, 101 R, 101 T; 85/39

[56] References Cited

UNITED STATES PATENTS

| | | | |
|---|---|---|---|
| 2,154,012 | 4/1939 | Rhodes | 24/90 E |
| 2,254,418 | 9/1941 | Carley | 24/90 PR |
| 2,299,493 | 10/1942 | Purinton | 24/90 E |
| 2,452,173 | 10/1948 | Zwiebel | 24/90 E |
| 2,480,262 | 8/1949 | Purinton | 24/90 E |
| 2,901,800 | 9/1959 | Koehl | 85/39 |
| 2,928,151 | 3/1960 | Rozanski | 24/90 PR |
| 3,028,646 | 4/1962 | Janes | 24/90 PR |
| 3,252,493 | 5/1966 | Smith | 85/39 |

FOREIGN PATENTS OR APPLICATIONS

| | | | |
|---|---|---|---|
| 710,996 | 6/1965 | Canada | 24/90 PR |
| 597,673 | 1/1948 | United Kingdom | 24/90 PR |

*Primary Examiner*—Bernard A. Gelak
*Attorney, Agent, or Firm*—Hill, Gross, Simpson, Van Santen, Steadman, Chiara & Simpson

[57] ABSTRACT

Buttons, especially for workmen's and leisure clothing include riveted to the fabric; a button thus including a male portion and a female portion. The riveting requires a hole being punched in the fabric, and the two portions of the button must be designed in such a manner that they are securely retained. By manufacturing the portions of a material having high frictional properties and shaping and selecting the dimensions of the stud of the male part and the mating bore of the female portion with a negative clearance, not only a secure retention, but also an ability of "self punching" the necessary hole in the fabric is obtained. For use with heavier fabric the female portion may be reinforced with a metal lining.

3 Claims, 4 Drawing Figures

BUTTON INCLUDING A MALE AND FEMALE PORTION

BACKGROUND OF THE INVENTION

1. Field of the Invention

The present invention refers in general to 2 piece buttons, primarily intended for workmen's and leisure clothing, but which may be shaped and colored in a manner to make them suitable also for other uses.

2. Prior Art

In the ready to wear clothing business, every manual operation must be carefully watched, and as there usually is a number of buttons in each piece of clothing, special care must be taken with respect to the shape of the buttons, and the manner of attaching the same.

A common method of attaching buttons used when manufacturing leisure and workmen's clothing is riveting. This method usually presupposes a metallic material in the button and its counterpart, which is unsuitable, for instance, with respect to machine laundering. Furthermore the fabric is easily damaged when the button is subjected to a load, as the force will be transferred to the fabric merely at the rivet.

SUMMARY OF THE INVENTION

An object of the present invention is to provide a button which is well suited for highly automated attachment, and which, when attached to the fabric, will remain in position and simultaneously keep an area of the fabric firmly clamped between its parts, said area being considerably larger than that of the cross-section of the stud.

A button, or a fitting, according to the invention includes a male portion and a female portion, each of said portions being provided with a face to be directed toward the other portion, at least one stud projecting from one of said faces and a corresponding number of mating bores being provided at the other face. Both portions are manufactured of a synthetic resin material having high frictional properties, each stud on the male portion having a larger cross-sectional area than that of the mating bore in the female portion, the depth of said bore exceeding the length of the stud, and the stud and the mouth of the bore having sharp edges for punching holes in the fabric.

AS SHOWN ON THE DRAWINGS:

The two portions of a 2-piece button are manufactured of a synthetic resin material having high frictional properties. A suitable material is an acetal resin, commercially available from The Dupont Company under the trade mark DELRIN.

Figure 1:
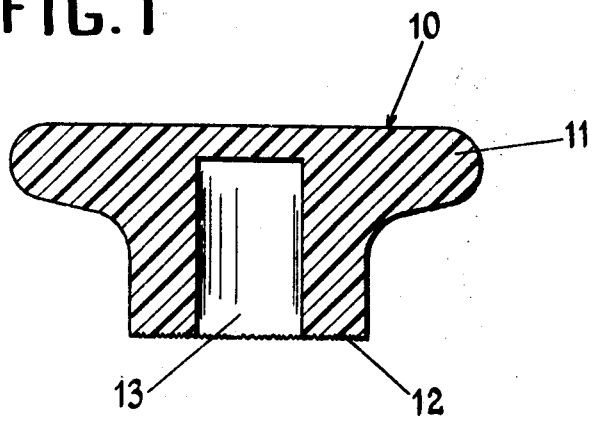
FIG. 1, on a large scale, shows a cross-section through the female portion of a button.

The female portion 10 shown in FIG. 1 is the button proper and includes a head 11 suited for cooperation with a buttonhole. Within its side face 12, to be directed against the piece of fabric to which the button is to be attached, the female portion is provided with a bore 13 directed perpendicularly with respect to said side face. The mouth of the bore is defined by a sharp edge, and the face outside the bore is rough or knurled.

The male portion 14 is formed of plastic to have a disk 15, from which a centrally located stud 16 projects. The end face of the stud has a sharp edge and the surrounding side face 17 is rough or knurled.

The diameter of the stud 16 is somewhat larger than the diameter of bore 13. With a button of normal size this difference will amount to a few tenths of a millimeter so that the interference produces a press-fit. The depth of the bore is greater than the length of the stud, to ensure that the latter will never reach the bottom of the bore. In this manner sufficient space is provided for the reception of the blank of fabric punched out when assemembling the two portions of the button together.

The bore may pass completely through the female portion. By selecting different colours for the material in the male portion and in the female portion, respectively, a certain pattern may be established.

By providing sharp edges at the end face of the stud and at the mouth of the bore, respectively, the portions of the button punch a hole in fabric without an extra operation for that purpose. The two portions of the button are placed at opposite sides of the fabric, with the side faces 12 and 17 facing the fabric, and with the stud exactly centered with respect to the bore. The two portions are then pressed together and the resulting clamping action is sufficient to provide the desired hole in the fabric.

As the stud is somewhat wider than the bore, but mainly due to the high frictional properties of the material, the male portion and the female portion are securely retained in the clamped position.

The assembling is performed in such a manner that the fabric is clamped between the side faces 12 and 17. As these faces are held together good grip upon the material is obtained, and any radial load upon the button will be distributed over a larger area of fabric than would be the case with a conventional 2-part rivet, which in assembled position has an axial clearance between its parts and the fabric.

In practice, the arrangement above described is limited to certain thicknesses and qualities of the fabric. In most workmen's clothing the fabric is folded over along the hems and in other places where buttons are to be attached. The resistance offered by the fabric may then be so high, that there may be a tendency of unwanted deformation of the stud and/or of the sharp edge at the mouth of the bore. There then could be no cutting out of a clearly defined blank from the fabric. The lowermost layer of fabric would be torn so threads will follow the stud into the bore. This changes the fit for the retention, and increases the stresses upon the material of the female portion.

In order to facilitate the punching operation, a lining of hard material, preferably stainless steel, at least partly covering the side face of the female portion, is recessed thereinto, said lining being provided with an opening having a slightly larger area than the bore in the female portion. There is thus a slight radial clearance which facilitates centering of the stud.

The highest expansion strain in the female portion appears just when the end of the stud enters the mouth of the bore. Due to the reinforcement offered by the recessed lining of stronger material, the front end of the stud will be protected. Furthermore the female portion may be made with a smaller gauge, which is desirable with respect to saving of material as well as to use.

Figure 3:
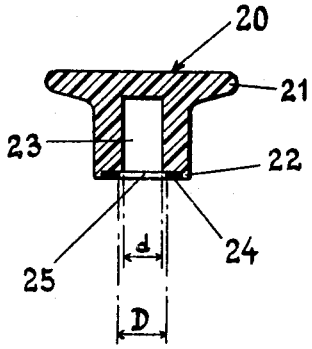
FIG. 3 shows a first modification of the female portion.

The female portion 20 shown in FIG. 3 corresponds in major features to that shown in FIG. 1 and is provided with a head 21 adapted for cooperation with a buttonhole. From the side face 22, to be directed towards the male portion, a bore 23 extends perpendicularly to the plane of the side face into the body of the portion, said bore being dimensioned in the manner described above.

In the present embodiment, a thin washer 24 of stainless steel is recessed into the side face 22. This washer, which serves as a lining, is provided with an opening 25, the diameter D of which is slightly larger than the diameter d of bore 23. The opening 25 is defined by a sharp edge and will, during assembly, serve as a die and as a guide for the stud of the male portion, and ensures in this manner an efficient cutting off of the threads of the fabric. The arrangement permits the use of this kind of buttons also with plastic coated fabric, canvas and the like.

Figure 4:
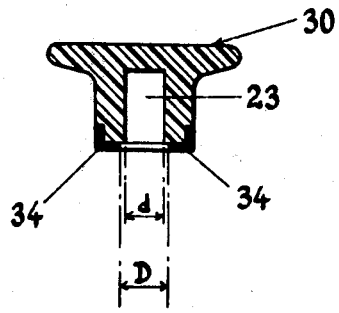
FIG. 4 shows a second modification thereof.

The embodiment 30 shown in FIG. 4 corresponds to that above described, but here the lining 34 is formed as a ferrule enclosing the end of the body of the female portion.

Figure 2:
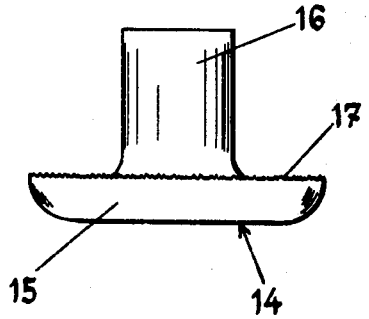
FIG. 2 shows an elevation of a male portion, mating with the female portion.

With buttons where the male portion is provided with two or more studs, each bore in the female portion may be surrounded by a circular washer, as shown in FIG. 2, but the two washers may be formed as a unitary lining covering two or more bores.

The invention may also be used with clasps and other fittings commonly used on clothing and the expression button should be interpreted in a broad sense. With such clasps and fittings, more than one stud may be provided at each male portion. In such a case, the corresponding bores in the female portion can each be surrounded by a circular washer, or a single washer surrounding more than one bore may be provided.

What I claim is:

1. A button comprising:

a. a female portion of plastic having at one end an enlarged head for cooperating with a buttonhole, and having a first flat annular face at its other end for engaging fabric, said first flat annular face encircling a cylindrical bore having a sharp cutting edge adjacent to said first face engageable with the fabric; and b. a male portion of plastic, there being at one end a disk having a second flat annular face for clamping onto fabric in cooperation with said first annular face, said second annular face encircling a cylindrical stud having a smooth outside diameter slightly larger than that of said cylindrical bore and being receivable therein, said cylindrical surface terminating in a sharp cutting edge coactive with said cutting edge of the female portion during assembly to cut the fabric smoothly, the length of said stud being less than the length of said bore.

2. A button according to claim 1 in which there is at one of said cutting edges a short region of slight radial clearance between said portions for initially centering said stud with respect to said bore.

3. A button according to claim 1 in which said plastic comprises an acetal resin, whereby the cylindrical surfaces of said portions have a high coefficient of friction for preventing separation of said portions.

* * * * *